US005216196A

United States Patent [19]

Anderson

[11] Patent Number: 5,216,196

[45] Date of Patent: Jun. 1, 1993

[54] SAFE & ARMING DEVICES FOR ROCKET WARHEADS AND PROJECTILES

[75] Inventor: Richard V. Anderson, Arlington, Tex.

[73] Assignee: BEI Electronics, Inc., San Francisco, Calif.

[21] Appl. No.: 743,273

[22] Filed: Aug. 9, 1991

[51] Int. Cl.[5] ..... F42C 15/188

[52] U.S. Cl. ..... 102/235; 102/251

[58] Field of Search ..... 102/235, 231, 254, 222

[56] References Cited

U.S. PATENT DOCUMENTS

| | | | |
|---|---|---|---|
| 1,311,104 | 7/1919 | Watson | 102/235 |
| 1,842,467 | 1/1932 | Woodberry | 102/235 |
| 3,347,166 | 10/1967 | Simmen | 102/235 |
| 4,782,757 | 11/1988 | Carter | 102/254 |

FOREIGN PATENT DOCUMENTS

| | | | |
|---|---|---|---|
| 186056 | 11/1963 | Sweden | 102/235 |

OTHER PUBLICATIONS

Department of the Army Technical Manual TM Sep. 1990, (also Department of the Air Force Technical Order to 11A-1-201) entitled Ammunition General, Jun. 1956, front cover and pp. 132 and 133.

U.S. Army Materiel Command publication No. AMCP 706-108, entitled Research and Development of Materiel, Engineering Design Handbook, Elements of Armament Engineering, Part Three, Weapon Systems and Components, Jul. 1963, front cover and pp. 12-4 and 12-5.

*Primary Examiner*—Stephen M. Johnson

*Attorney, Agent, or Firm*—Palmatier & Zummer

[57] ABSTRACT

The safe and arming device comprises a housing containing a setback weight movable rearwardly against the resistance of springs in response to forward acceleration of the housing. A fire tube in the housing has a fire tube opening, blocked initially by first and second swingable inertial arming lugs. The weight carries a pin having a first portion initially received in a first opening in the first lug for retaining it in its safe position. The setback of the weight withdraws the first pin portion from the first opening. Spin acceleration causes swinging of the first lug to its arming position wherein a detonator on the lug is aligned with the fire tube opening. The lug has a second opening for receiving a second pin portion when the weight is spring-returned after cessation of the acceleration, whereby the lug's arming position is maintained. The second lug has a third opening for receiving a third pin portion to maintain the safe position of the second lug. When the housing decelerates due to air friction, the weight moves forwardly and releases the second lug. Negative spin acceleration or a spring causes the second lug to swing to its arming position wherein an opening therein is aligned with the fire tube opening. A latch retains the second lug in its arming position. The first lug has a ramp, engageable by the first pin portion to return such lug to its safe position if it is only partially swung toward its arming position.

30 Claims, 4 Drawing Sheets

SAFE & ARMING DEVICES FOR ROCKET WARHEADS AND PROJECTILES

FIELD OF THE INVENTION

This invention relates to safe and arming devices to insure that warheads and projectiles can be safely handled, shipped and launched or fired, while providing for the reliable arming of the warhead or projectile during the flight thereof so that the explosive charge in the warhead or projectile will be detonated in the intended manner, at or near the intended target.

BACKGROUND OF THE INVENTION

All rocket warheads and other military projectiles, such as artillery shells, for example, are provided with various safe and arming devices, for preventing the premature detonation of the main explosive charge in the warhead or projectile, whereby the warhead or projectile can be safely handled, shipped and launched or fired, and whereby the warhead or projectile will be armed after it has been launched or fired, and after it has traveled a safe distance along its flight to the intended target.

Various safe and arming devices are known to those skilled in the art. For example, a safe and arming device is known which is intended to interrupt the firing train of an explosive charge or munition, to prevent the firing train from functioning except under predetermined specific design circumstances, including the inertial setback force of the launch, followed by a time delay, imposed upon the mechanism for bringing the detonator in line with the firing train. The time delay may be produced by a mechanical timing mechanism of the run-away clock escapement type. The time delay mechanism has numerous moving parts and is complex and expensive.

OBJECTS OF THE INVENTION

One object of the present invention is to provide a new and improved safe and arming device which is much simpler, less expensive and more reliable than heretofore, yet incorporates more safety features, in that the device requires an increased number of environmental stimuli to arm the firing train. For example, in one embodiment, the safe and arming device requires four environmental stimuli to arm the firing train.

A further object of the present invention is to provide a new and improved safe and arming device of the foregoing character, in which the prerequisites for arming the firing train include a sufficient setback force due to the normal launching or firing of the rocket or other projectile; a requisite spin acceleration of the rocket or other projectile; and a requisite deceleration of the rocket or projectile due to the drag imposed by air friction.

In one embodiment, a requisite negative spin acceleration is also required to arm the firing train.

SUMMARY OF THE INVENTION

To achieve these and other objects, the present invention may provide a safe and arming device for warheads and projectiles, such device comprising a housing having first, second and third successive chambers therein; a setback weight assembly including an acceleration responsive setback weight movable in the second chamber in first and second opposite directions along a predetermined path between an initial position and a setback position; spring means for resiliently biasing the setback weight in the first direction toward the initial position, the setback weight being movable in the second direction relative to the housing to the setback position in response to predetermined acceleration of the housing in the first direction; the housing having fire tube means along the path for propagating fire in the second direction; a first inertial arming lug movable in the first chamber; detonator means mounted on the first swingable arming lug; first pivot means connected between the housing and the first inertial lug and supporting the lug for swinging movement in the first chamber in first and second angular directions between an initial safe position, with the detonator means out of alignment with the fire tube means, and an arming position, with the detonator means aligned with the fire tube means; the setback weight assembly comprising first control pin means thereon including a first pin portion movable into and out of the first chamber; the first inertial lug having a first control opening for receiving the first pin portion when the first inertial lug is in the safe position whereby the first inertial lug is retained in the safe position by the first pin portion; movement of the weight to the setback position being operative to withdraw the first control pin means from the first control opening for releasing the first inertial lug; the first inertial lug being responsive to spin acceleration of the housing for causing relative swinging movement of the first inertial lug and the housing to bring the first inertial lug to the arming position; a second inertial lug movable in the third chamber; and second pivot means connected between the housing and the second inertial lug and supporting the second inertial lug for swinging movement between safe and arming positions; the second inertial lug having means operative in the safe position thereof for blocking the fire tube means; the second inertial lug having a fire-propagating opening therein movable into alignment with the fire tube mean when the second inertial lug is swung into the arming position to provide for propagation of fire along the fire tube means; the setback weight assembly including second control pin means movable in opposite directions into and out of the second chamber; the second inertial lug having a second control opening therein for receiving the second control pin means when the second inertial weight is in its safe position; the second control pin means being partially received in the second control opening for initially holding the second inertial lug in its safe position; the second control pin means being movable farther into the second control opening in response to setback movement of the weight; the first inertial lug having an additional control opening therein aligned with the first control pin means when the first inertial lug is in its arming position; the first control pin means having an additional pin portion of larger size than the first pin portion and being aligned with the additional control opening when the first inertial lug is in its arming position; the weight being movable relative to the housing along the predetermined path between the initial position and a forwardly displaced position in response to predetermined deceleration of the housing due to air friction drag on the warhead or projectile; the spring means being operative to bias the weight from its forwardly displaced position toward its initial position; the additional pin portion being movable into the additional control opening while the second control pin means is withdrawn from the second control opening in response to movement of the weight between its initial position and its forwardly displaced position, whereby the second inertial lug is released to enable swinging movement thereof; the second inertial lug being constructed and arranged for producing swinging movement of the second inertial lug from its safe position to its arming position after the second inertial lug is released by the withdrawal of the second control pin means from the second control opening.

The safe and arming device preferably includes latching means for latching the second inertial lug in its arming position.

The first inertial lug preferably includes safeing ramp means engageable by the first control pin means in response to deceleration of the housing for returning the first inertial lug to its safe position if the first inertial lug is in an intermediate position between its safe and arming positions.

The safeing ramp means may extend between the additional control opening and the first control opening.

The spring means preferably comprises a coil spring received around the second control pin means and operative between the setback weight and a portion of the housing.

The safe and arming device may comprise a pair of such spring means, a pair of the first control pin means including a pair of the first pin portions, a pair of the first control openings for receiving the pin portions, a pair of the second control pin means, a pair of the second control openings for receiving the second control pin means, a pair of additional control openings in the first inertial lug, and a pair of portions of larger size than the first pin portions.

The safe and arming device preferably comprises a pair of the safeing ramp means.

The spring means may comprise a pair of coil springs.

The first control pin means and the second control pin means may comprise respective first and second portions of a unitary control pin formed in one piece and mounted on the setback weight.

The device may comprise a pair of the unitary control pins mounted in parallel positions on the setback weight.

The housing preferably comprises guide means disposed between the second and third chambers and having guide openings for slidably guiding the unitary control pins.

The spring means may comprise a pair of coil springs received around the second portions of the unitary control pins and operative between the setback weight and the guide means.

The safe and arming device may comprise an explosive booster pellet mounted in the fire-propagating opening in the second inertial lug.

The second inertial lug is preferably swingable relative to the housing in response to reverse spin acceleration of the housing whereby the second inertial lug is swung into its arming position after the second inertial lug is released by the withdrawal of the second control pin means from the second control opening.

The second inertial lug and the second pivot means are preferably constructed and arranged such that the second inertial lug is swingable between its safe and arming positions in an angular direction which is opposite from the direction of swinging movement of the first inertial lug between its safe and arming positions.

In another embodiment, the safe and arming device may comprise additional spring means operative between the housing and the second inertial lug for resiliently biasing the second inertial lug toward its arming position whereby the second inertial lug is swung into the arming position after the second inertial lug is released by the withdrawal of the second control pin means from the second control opening.

In such embodiment, the first and second inertial lugs are swingable in the same angular direction between their respective safe and arming positions.

In a broader conception, the present invention may provide a safe and arming device for warheads and projectiles, such device comprising a housing having at least first and second chambers therein; a setback weight assembly including an acceleration responsive setback weight movable in the second chamber in first and second opposite directions along a predetermined path between an initial position and a setback position; spring means for resiliently biasing the setback weight in the first direction toward the initial position, the setback weight being movable in the second direction relative to the housing in response to acceleration of the housing in the first direction; the housing having fire tube means for propagating fire therealong; an inertial arming lug movable in the first chamber; detonator means mounted on the inertial arming lug; pivot means connected between the housing and the inertial arming lug and supporting the lug for swinging movement in the first chamber in first and second angular directions between an initial safe position, with the detonator means out of alignment with the fire tube means, and an arming position, with the detonator means aligned with the fire tube means; the setback weight assembly comprising control pin means thereon movable into and out of the first chamber; the inertial arming lug having a first control opening for receiving the control pin means when the inertial arming lug is in the safe position whereby the inertial arming lug is retained in the safe position by the control pin means; movement of the weight to the setback position being operative to withdraw the control pin means from the first control opening for releasing the inertial arming lug; the inertial arming lug being responsive to spin acceleration of the housing for causing relative swinging movement of the inertial arming lug and the housing to bring the inertial arming lug to the arming position thereof; the inertial arming lug having an additional control opening therein aligned with the control pin means when the inertial arming lug is in its arming position; the control pin means being movable into the additional control opening in response to return of the weight to its initial position the control pin means thereby being effective to retain the inertial arming lug in its arming position.

The inertial arming lug preferably includes safeing ramp means engageable by the control pin means in response to return movement of the weight for returning the inertial arming lug to its safe position if the inertial arming lug is in an intermediate position between its safe and arming positions.

The safeing ramp means may extend between the additional control opening and the first control opening.

The safe and arming device may comprise a pair of the control pin means, a pair of the first control openings for receiving the control pin means when the inertial arming lug is in its safe position, and a pair of additional control openings for receiving the control pin means when the inertial arming lug is in its arming position.

The inertial arming lug preferably includes a pair of safeing ramp means engageable by the pair of control pin means in response to return movement of the weight for returning the inertial arming lug to its safe position if the inertial arming lug is in an intermediate position between its safe and arming positions.

The housing preferably comprises a pair of guide means for slidably receiving and guiding the control pin means for movement of the setback weight and the control pin means in the first and second directions.

In a still broader conception, the present invention provides a safe and arming device for warheads and projectiles, such device comprising a housing, an acceleration responsive setback weight in the housing, guide means for guiding the setback weight for movement in the housing in first and second opposite directions along a predetermined path between an initial position and a setback position; resilient means for resiliently biasing the setback weight in the first direction toward the initial position; the setback weight being movable in the second direction relative to the housing to the setback position in response to predetermined acceleration of the housing in the first direction; the housing having fire tube means for propagating fire therealong; an inertial arming lug movable in the housing; detonator means mounted on the inertial arming lug; pivot means extending between the housing and the inertial arming lug and supporting the lug for swinging movement between an initial safe position, with the detonator means out of alignment with the fire tube means, and an arming position, with the detonator means aligned with the fire tube means; control means operable by the setback weight for initially retaining the inertial arming lug in its safe position when the setback weight is in its initial position; the control means being operable by setback movement of the weight to its setback position for releasing the inertial arming lug; the inertial arming lug being responsive to spin acceleration of the housing for causing relative swinging movement of the inertial arming lug and the housing to bring the inertial arming lug to the arming position thereof; the control mean being operative to retain the inertial arming lug in its arming position in response to return movement of the setback weight to its initial position.

Such control means may include first means operable by setback movement of the weight to its setback position for releasing the inertial arming lug; and second means operable by return movement of the setback weight to its initial position for retaining the inertial arming lug in its arming position.

More specifically, the control means may comprise first pin means operable by the setback weight for initially retaining the inertial arming lug in its safe position when the setback weight is in its initial position; the first pin means being operable by setback movement of the weight to its setback position for releasing the inertial arming lug; the control means also including second pin means operable by return movement of the setback weight to its initial position for retaining the inertial arming lug in its arming position.

The inertial arming lug preferably comprises a first control opening for receiving the first pin means when the inertial arming lug is in its safe position; and an additional control opening for receiving the second pin means when the inertial arming lug is in its arming position.

The safe and arming device preferably includes resetting means operable by the control means for returning the inertial arming lug to its safe position in response to return movement of the setback weight to its initial position if the inertial arming lug is in an intermediate position between its safe position and its arming position.

The resetting means preferably includes ramp means on the inertial arming lug and engageable by the control means.

In an even broader conception, the present invention provides a safe and arming device for warheads and projectiles, such device comprising a housing; an acceleration responsive weight in the housing; guide means for guiding the weight for movement in the housing in first and second opposite directions along a predetermined path between an initial position and a setback position; resilient means for resiliently biasing the weight in the first direction toward the initial position; the weight being movable in the second direction relative to the housing to the setback position in response to acceleration of the housing in the first direction; firing train means in the housing; an inertial arming lug movable in the housing; the firing train means having an indispensable element thereof on the inertial arming lug; pivot means extending between the housing and the inertial arming lug and supporting the lug for swinging movement between an initial safe position, with the indispensable element out of operative relation with the firing train means, and an arming position, with the indispensable element in an operative relation with the firing train means; control means operable by the weight for initially retaining the inertial arming lug in its safe position when the weight is in its initial position; the control means being operable by setback movement of the weight to its setback position for releasing the inertial arming lug; the inertial arming lug being responsive to spin acceleration of the housing for causing relative swinging movement of the inertial arming lug and the housing to bring the inertial arming lug to the arming position thereof; the control means being operative to retain the inertial arming lug in its arming position in response to return movement of the weight to its initial position.

The control means may include first means operable by setback movement of the weight to its setback position for releasing the inertial arming lug; and second means operable by return movement of the weight to its initial position for retaining the inertial arming lug in its arming position.

Such safe and arming device preferably includes a second inertial arming lug movable in the housing; the firing train means having a second indispensable element thereof on the second inertial arming lug; pivot means extending between the housing and the second inertial arming lug and supporting the second lug for swinging movement between an initial safe position, with the second indispensable element out of operative relation with the firing train means, and an arming position, with the second indispensable element in an operative relation with the firing train means; additional control means operable by the weight for initially retaining the second inertial arming lug in its safe position when the weight is in its initial position; the additional control means being operative to continue to retain the second inertial arming lug in its safe position in response to setback movement of the weight to its setback position; the guide means being additionally operative to guide the weight between its initial position and a forwardly displaced position; the resilient means being additionally operative to bias the weight in the second direction from its forwardly displaced position to its initial position; the weight being operable in response to predetermined deceleration of the housing for causing relative movement of the weight and the housing to bring the weight to its forwardly displaced position; the additional control means being operable by movement of the weight to its forwardly displaced position for releasing the second inertial arming lug; the second inertial arming lug being constructed and arranged for producing swinging movement of the second inertial arming lug from its safe position to its arming position when the second inertial arming lug is released by the additional control means.

Such safe and arming device preferably includes latching means for latching the second inertial arming lug in its arming position.

The second inertial arming lug is preferably swingable relative to the housing in response to reverse spin acceleration of the housing whereby the second inertial arming lug is swung into its arming position after the second inertial arming lug is released by the additional control means.

The second inertial arming lug and the second pivot means are preferably constructed and arranged such that the second inertial arming lug is swingable between its safe and arming positions in an angular direction which is opposite from the direction of swinging movement of the first inertial arming lug between its safe and arming positions.

In another embodiment, the safe and arming device preferably comprises additional resilient means operative between the housing and the second inertial arming lug for resiliently biasing the second inertial arming lug toward its arming position whereby the second inertial arming lug is swung into its arming position after the second inertial arming lug is released by the additional control means.

The first and second inertial arming lugs are preferably swingable in the same angular direction between their respective safe and arming positions.

BRIEF DESCRIPTION OF THE DRAWINGS

Further objects, advantages and features of the present invention will appear from the following description, taken with the accompanying drawings, in which.

DETAILED DESCRIPTION OF ILLUSTRATIVE EMBODIMENTS

Figure 2:
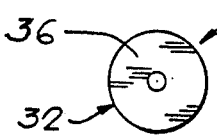
FIG. 2 is an end or plan view of the safe and arming device.
Figure 1:
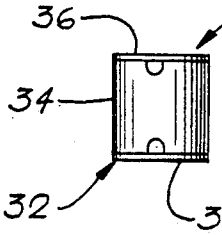
FIG. 1 is a longitudinal or elevational view of a safe and arming device to be described as an illustrative embodiment of the present invention.

As just indicated, FIGS. 1 and 2 illustrate a safe and arming device 30, adapted to be inserted into the firing train of a warhead for a military rocket. The safe and arming device 30 may also be employed in an artillery shell or some other projectile. The safe and arming device 30 causes the firing train to be inoperative initially, so that the rocket or projectile can be handled, shipped, stored and fired safely, without any danger that the main explosive charge of the warhead or projectile will be prematurely detonated. When the rocket or projectile is launched or fired, the safe and arming device 30 causes the firing train to be rendered operative, in response to several successive environmental factors which are experienced by the warhead or projectile during the launching or firing thereof and the early portion of the flight thereof.

The illustrated safe and arming device 30 comprises a generally cylindrical housing 32 having a substantially cylindrical side wall or body 34 which is provided with first and second end walls 36 and 38 that will sometimes be referred to as the front and rear end walls, respectively.

Figure 3:
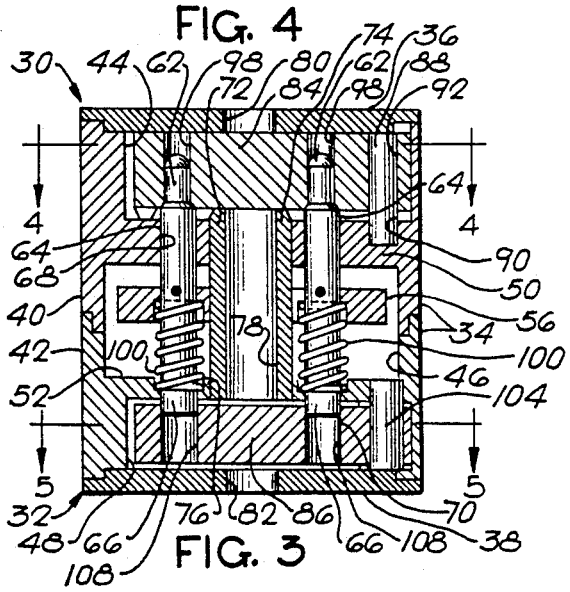
FIG. 3 is a longitudinal section taken through the device, generally along the line 3—3 in FIG. 4, and showing the device in its initial safe condition.
Figure 5:
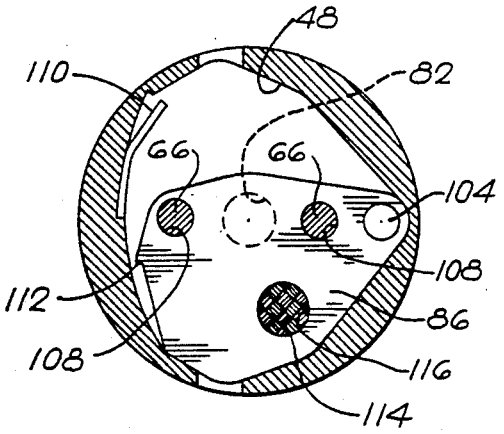
FIG. 5 is a cross-sectional view, taken generally along the line 5—5 in FIG. 3, and showing the safe initial position of the second or lower swingable arming lug.

As shown in the greatly enlarged sectional view of FIG. 5, the generally cylindrical side wall 34 of the housing 32 comprises first and second generally cylindrical components 40 and 42 which are press-fitted, bonded or otherwise secured together. Preferably, the housing 32 is formed with first, second and third chambers 44, 46 and 48 for receiving the moving parts of the safe and arming device 30. As shown in FIG. 3, the first chamber 44 is formed between the end wall 36 and a first partition wall 50 extending across the first component 40 of the cylindrical side wall 34. The second chamber 46 is formed between the first partition wall 50 and a second partition wall 52, extending across the second component 42 of the generally cylindrical side wall 34.

The safe and arming device 30 comprises a first moving part in the form of an acceleration responsive weight assembly or means 54, including an acceleration responsive weight 56, sometimes referred to as the setback weight, movably received in the second chamber 46. The weight assembly 54 is illustrated separately in FIGS. 15 and 16. It will be seen that the weight 56 is generally in the form of a massive disk, movable along a predetermined path in first and second opposite directions in the second chamber 46 of the housing 32. The directions will sometimes be referred to as forward and rearward. The movement of the weight 56 is guided by guide means comprising components of the weight assembly 54 and also components on the housing 32. Thus, the weight assembly 54 comprises pin means, including at least one and preferably a pair of pins 58, extending through respective openings 60 in the weight 56 and suitably secured to the weight. The pins 58 extend through the weight 56 at right angles thereto and substantially parallel with the first and second opposite directions of movement of the weight 56.

Figure 15:
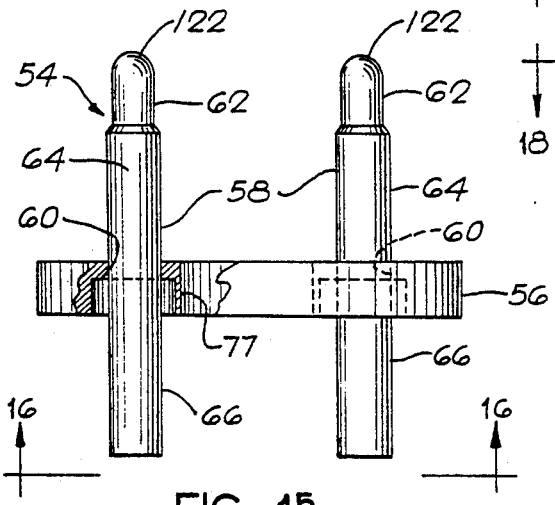
FIG. 15 is a longitudinal or elevational view of the inertial setback weight assembly, partly in section along the line 15—15 in FIG. 16.
Figure 16:
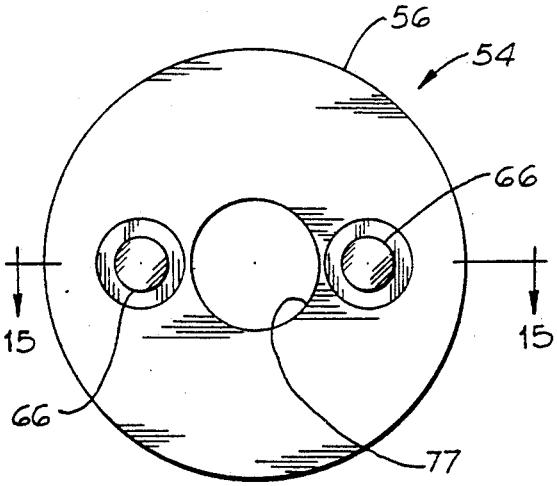
FIG. 16 is an end or bottom plan view of the inertial setback assembly, taken as indicated by the line 16—16 in FIG. 15.

As shown in FIG. 15, each of the pins 58 has a first or front end portion 62 of reduced diameter, projecting forwardly from a second or intermediate portion 64, extending forwardly from the weight 56 and received in one of the openings 60 therein. In addition, each pin 58 has a third or rear portion 66, projecting rearwardly from the weight 56. The second and third portions 64 and 66 of each pin 58 have the same diameter.

The second or intermediate portions 64 of the pins 58 are slidably guided in openings 68 formed in the first partition 50, as shown in FIG. 3. The third or rear portions 66 of the pins 58 are slidably guided in corresponding openings 70, formed in the second partition 52.

Guidance for the weight 56 is also provided by a central tube 72, mounted axially in the housing 32 and extending through openings 74 and 76 in the respective partitions 50 and 52. The tube 72 is press-fitted, bonded or otherwise securely mounted in the housing 32. The weight 56 has a central opening 77 which slidably receives the central tube 72, whereby the weight 56 is slidably guided by the tube 72.

The safe and arming device 30 comprises fire tube means for propagating the detonating fire or explosive energy, for detonating the main explosive charge of the warhead or projectile. The central tube 72 constitutes a portion of such fire tube means and has an axial bore or opening 78 along which the detonating fire is adapted to be propagated. Additional portions of the fire tube means are afforded by axial openings 80 and 82 in the respective end walls 36 and 38 of the housing 32.

Figure 4:
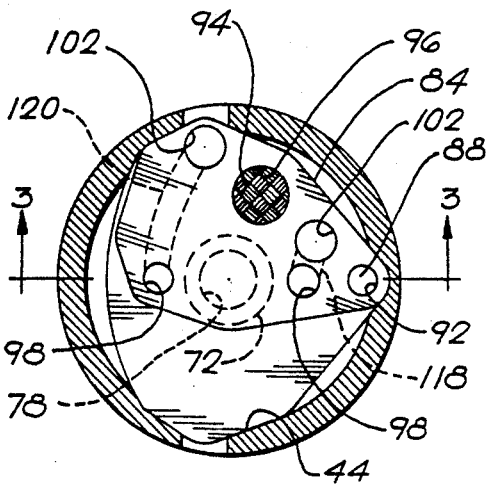
FIG. 4 is a cross-sectional view, taken generally along the line 4—4 in FIG. 3, and showing the safe initial position of the first or upper swingable arming lug.

The safe and arming device 30 comprises first and second arming means which are movable between safe and arming positions, such means being illustrated in FIGS. 3, 4 and 5 as comprising first and second movable arming lugs 84 and 86 which are movable in the first and third chambers 44 and 48 in the housing 32. Each of the movable arming lugs 84 and 86, when in its safe position, is operative to disable the firing train of the warhead or projectile, preferably by blocking the fire tube means constituted by the axial openings 78, 80 and 82.

As shown in FIGS. 3 and 4, the first movable arming lug 84 is swingably movable in that it is swingably supported by pivot means comprising a first pivot pin 88 extending between the housing 32 and the arming lug 84. As illustrated, the pivot pin 88 is parallel with but spaced from the axis of the housing 32, and is securely received in an opening 90 in the partition wall 50 of the housing 32. The first arming lug 84 has a pivotal opening 92 which rotatably receives the pivot pin 88, whereby the lug 84 is swingable about the pivot pin 88.

Figure 10:
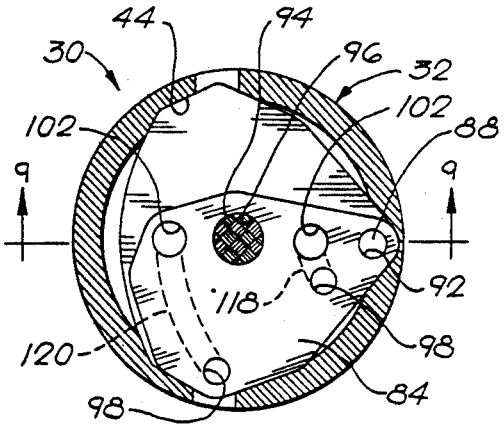
FIG. 10 is a cross-sectional view, taken generally along the line 10—10 in FIG. 9, and showing the changed position of the first swingable arming lug.
Figure 13:
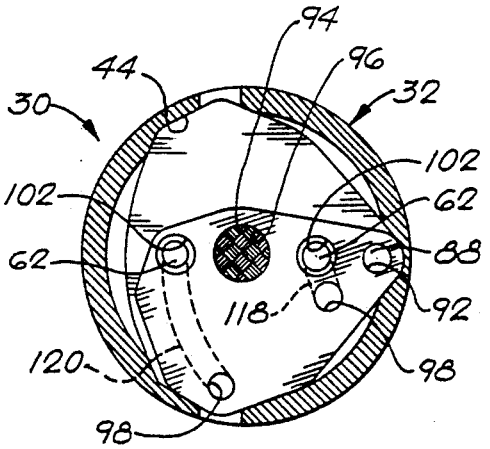
FIG. 13 is a cross-sectional view taken generally along the line 13—13 in FIG. 12.

In FIGS. 3 and 4, the swingable lug 84 is in its safe position, in which the lug disables the firing train by blocking any communication between the opening 80 in the end wall 36 and the fire tube opening 78 in the tube 72. The lug 84 is swingable about the pivot pin 88 in a counterclockwise direction to its arming position, as shown in FIGS. 10 and 13, in which an indispensable element of the firing train is moved into its operative position, such indispensable element being illustrated diagrammatically as taking the form of a detonator cap or other element 94, securely mounted in an opening 96 formed in the first arming lug 84. In the arming position of the lug 84, the detonator 94 is aligned with the fire tube openings 78 and 80 in the tube 72 and the end wall 36. In its arming position, the detonator 94 is adapted to be detonated or fired by suitable means, such as a firing pin, not shown.

Figure 7:
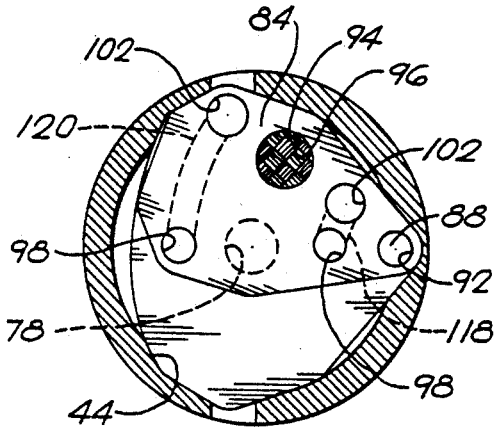
FIG. 7 is a cross-sectional view, taken generally along the line 7—7 in FIG. 6.

The first movable arming lug 84 is adapted to be swung in a counterclockwise direction from its safe position of FIGS. 4 and 7 to its arming position of FIGS. 10 and 13 in response to spin acceleration of the rocket or projectile. In the case of a rocket, the spin is produced by the rocket motor to impart stability to the flight of the rocket. In the case of a projectile adapted to be fired from a gun barrel, spin is imparted to the projectile by rifling in the barrel.

However, initially the first swingable lug 84 is retained in its safe position of FIGS. 4 and 7 by control means operable by the setback weight 56, such control means comprising the first or front pin portions 62 which are initially received in a pair of openings 98 in the swingable lug 84. The openings 98 are of a relatively small diameter, corresponding with the diameter of the first pin portions 62, so that they are slidably receivable in the openings 98, while the second or intermediate pin portions 64 are too large to enter the openings 98.

Resilient means, also referred to as spring means, as provided in the housing 32 for biasing the weight assembly 54 forwardly, or in the first direction, so as to maintain the reduced pin portions 62 in the openings 98 in the safe initial state of the safe and arming device 30, such resilient means being illustrated as a pair of coil springs 100 operatively connected between the housing 32 and the weight assembly 54. As shown in FIG. 3, the springs 100 are received around the third or rear pin portions 66.

When the rocket or projectile is launched or fired, the housing 32 of the safe and arming device 30 is abruptly accelerated in the first or forward direction, with the result that relative setback movement occurs between the setback weight 56 and the housing 32. The acceleration of the housing 32 is transmitted to the setback weight 56 by the springs 100 which are compressed by the setback force caused by the inertia of the weight 56. As a result, the weight 56 is moved rearwardly or in the second direction, relative to the housing 32, from the initial position, shown in FIG. 3, to the setback position, shown in FIG. 6. Consequently, the reduced pin portions 62 are withdrawn from the openings 98 in the first inertial arming lug 84, so that the lug is released for swinging movement. As previously described, a considerable spin acceleration is imparted to the rocket or projectile during the launching or firing thereof, so that a corresponding spin acceleration is imparted to the housing 32. Due to the inertia of the first arming lug 84, relative swinging movement is produced between the lug 84 and the housing 32, whereby the lug 84 is brought from its safe position of FIGS. 4 and 7 to its arming position of FIGS. 10 and 13, in which the detonator 94 is aligned with the fire tube openings 78 and 80.

Figure 12:
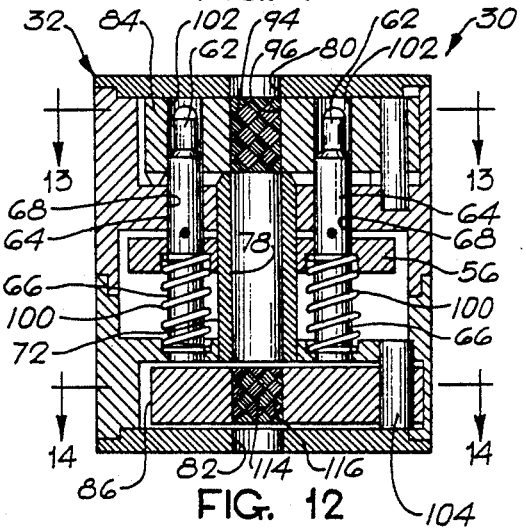
FIG. 12 is a longitudinal section, similar to FIG. 9, but showing the inertial setback weight assembly and the second or lower swingable arming lug in changed positions due to the deceleration of the rocket and the reverse spin acceleration imparted to the rocket during free flight.
Figure 11:
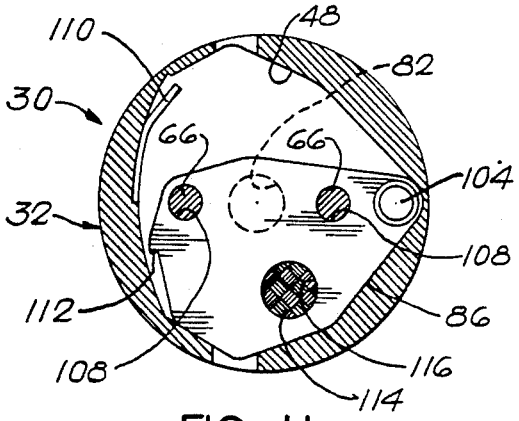
FIG. 11 is a cross-sectional view, taken generally along the line 11—11 in FIG. 9.

In the case of a rocket, the forward acceleration thereof is terminated when the rocket motor burns out. Similarly, the forward acceleration of a projectile, such as an artillery shell, is terminated when the shell leaves the gun barrel. When the forward acceleration of the housing 32 is correspondingly terminated, the resilient means or springs 100 return the setback weight 56 forwardly, as shown in FIG. 12, so that the first and second pin portions 62 and 64 of the pins 58 are inserted into openings 102 formed in the first swingable arming lug 84. The openings 102 are larger than the openings 98 and are sufficiently large to receive the second pin portions 64 as well as the first pin portions 62. The openings 102 are brought into alignment with the pin portions 62 and 64 by the counterclockwise swinging movement of the inertial lug 84 to its arming position, as shown in FIGS. 10 and 13. The openings 102 and the cooperating pin portions 62 and 64 function as control means for retaining the inertial lug 84 in its arming position.

The second inertial arming lug 86 provides an additional measure of safety in that the lug 86 initially blocks or disables the firing train, so that the safe and arming device 30 is still in a safe condition, after the first inertial arming lug 84 has been swung to its arming position by the spin acceleration of the rocket or projectile. As shown in FIGS. 3 and 5, the second inertial arming lug 86 is in its initial or safe position, in which it blocks communication between the opening 78 in the fire tube 72 and the axial opening 82 in the end wall 38 of the housing 32. The second inertial lug 86 is swingably supported by pivot means comprising a second pivot pin 104 which is securely mounted in the second partition wall 52 and is received with a sliding fit in a pivotal opening 106 in the second inertial lug 86.

In the initial condition of the safe and arming device 30, the second inertial arming lug 86 is in its safe position, at the counterclockwise limit of its range of movement, and is retained in its safe position by additional control means, comprising the third pin portions 66, which are partially received in control openings 108 formed in the lug 86.

Figure 6:
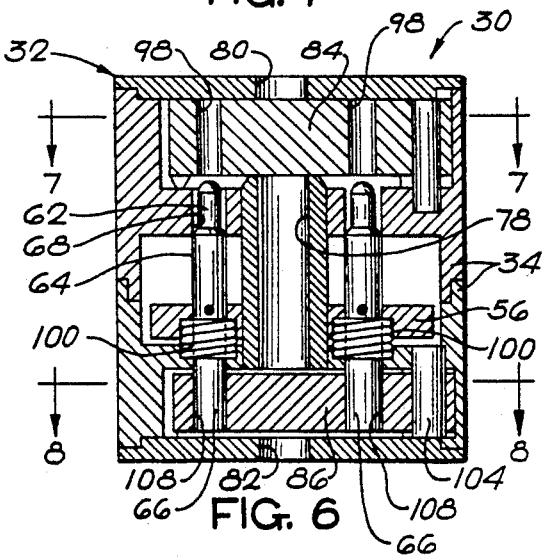
FIG. 6 is a longitudinal section similar to FIG. 3 but showing the inertial setback weight assembly in a changed position due to the acceleration of the device caused by the launching or firing of the rocket or projectile in which the safe and arming device is used.
Figure 8:
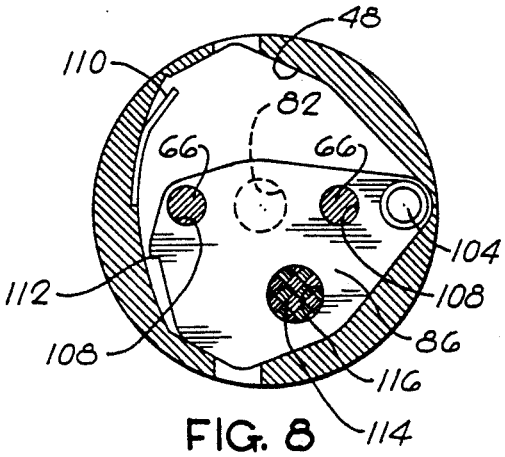
FIG. 8 is a cross-sectional view, taken generally along the line 8—8 in FIG. 6.

When the safe and arming device 30 is subjected to the abrupt forward acceleration due to the launching or firing of the rocket or projectile, the consequent rearward setback movement of the weight 56 causes the third pin portions 66 to move farther into the openings 108 in the second inertial lug 86, as shown in FIGS. 6 and 8. Thus, even though the first inertial lug 84 is swung to its arming position by the spin acceleration of the rocket or projectile, the second inertial lug 86 remains in its safe position.

During its flight toward the intended target, the rocket or projectile experiences deceleration, due to the drag caused by air friction. The deceleration of a rocket begins after the rocket motor burns out completely. In the case of a projectile, deceleration begins after the projectile moves away from the end of the gun barrel. The amount of deceleration depends in both cases upon the velocity achieved by the rocket or projectile. The safe and arming device 30 is constructed and arranged so that predetermined deceleration releases the second inertial arming lug 86 whereby it is enabled to swing to its arming position.

Deceleration of the housing 32 causes the inertial weight 56 to move in the first direction or forwardly relative to the housing 32, against the resilient biasing action of the springs 100, the opposite ends of which are suitably secured to the housing 32 and the weight 56. The requisite or sufficient amount of deceleration causes the weight 56 to move forwardly in the first direction to the position shown in FIG. 12, with the result that the third pin portions 66 are withdrawn from the control openings 108 in the second inertial arming lug 86, whereby the lug is released for swinging movement.

In the embodiment represented by FIGS. 3–14, the second arming lug 86 is constructed and arranged so that it will be swung to its arming position by negative or reverse spin acceleration which is experienced in flight by rockets of a particular construction, having warped tail fins adapted to produce negative spin acceleration due to the action of the air slip stream upon the tail fins. The negative spin acceleration shows down the positive spin velocity which is imparted to the rocket by the rocket motor.

Figure 14:
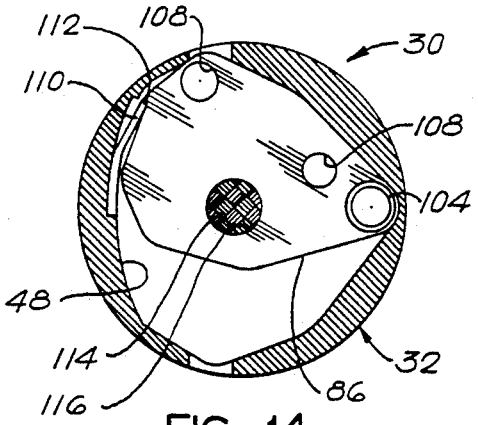
FIG. 14 is a cross-sectional view taken generally along the line 14—14 in FIG. 12, showing the changed position of the second swingable arming lug.

As shown in FIG. 14, the negative spin acceleration has caused the second inertial arming lug 86 to swing clockwise to its arming position, where it is retained by latching means comprising a latching leaf spring 110 adapted to be engaged by a latching tooth or shoulder 112 on the lug 86.

The second inertial lug 86 is constructed and arranged to bring a second indispensable element into operative relation with the firing train of the projectile or rocket warhead. As diagrammatically illustrated in FIGS. 12 and 14, the second indispensable element takes the form of an explosive booster pellet 114, securely mounted in an opening 116 in the second inertial lug 86. When the lug 86 is swung to its arming position, as shown in FIGS. 12 and 14, the opening 116 and the explosive booster pellet 114 are aligned with the axial fire tube openings 78, 80 and 82 so that the detonating fire or explosive energy from the detonator element 94 can be propagated along the firing train to the main explosive charge of the rocket warhead or projectile.

In many cases, the explosive booster pellet 114 is not necessary to detonate the main explosive charge, in which case the booster pellet 114 can be omitted from the opening 116 which will then be effective to propagate the detonating fire or energy to the main explosive charge.

As to the embodiment of FIGS. 3-14, the safe and arming device 30 must encounter four environmental factors in order to operate the safe and arming device from its safe condition of FIGS. 3-5 to its fully armed condition of FIGS. 12-14. These four factors are a sufficient magnitude of setback acceleration, a sufficient magnitude of spin acceleration, a sufficient magnitude of deceleration, and a sufficient magnitude of negative spin acceleration.

Figure 18:
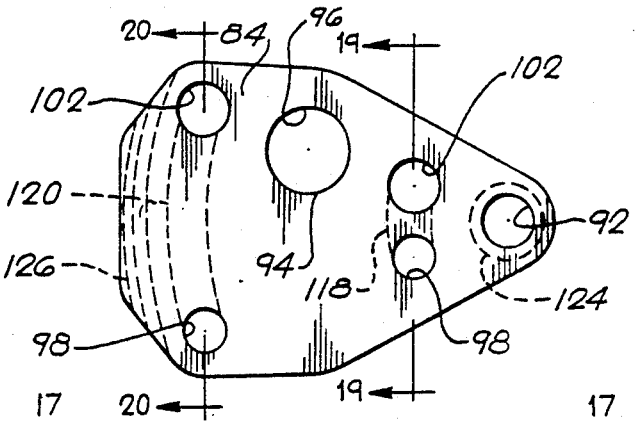
FIG. 18 is an end or plan view of the first swingable arming lug, taken generally as indicated by the line 18—18 in FIG. 17.
Figure 17:
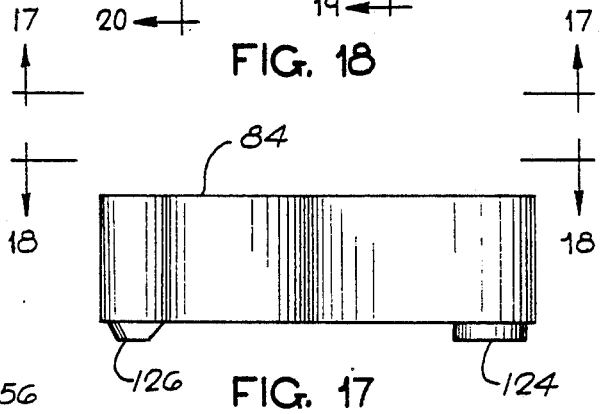
FIG. 17 is an elevational view of the first swingable arming lug, taken generally as indicated by the line 17—17 in FIG. 18.
Figure 19:
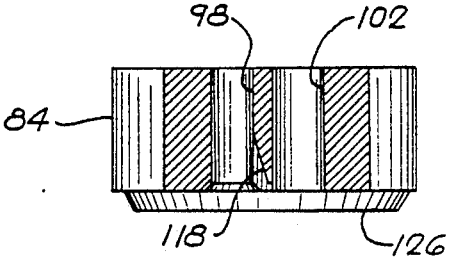
FIG. 19 is a sectional view, taken generally along the line 19—19 in FIG. 18, and showing the shorter safeing ramp.
Figure 20:
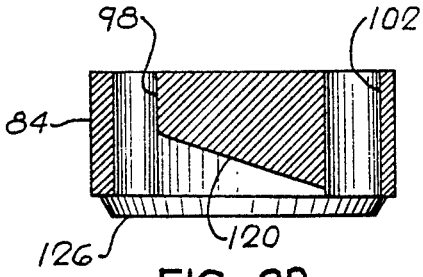
FIG. 20 is a sectional view, taken generally along the line 20—20 in FIG. 18, and showing the longer safeing ramp.

In some cases, the magnitude of the spin acceleration may not be sufficient to cause full swinging movement of the first inertial arming lug 84 to its arming position, shown in FIG. 10. The first inertial arming lug is constructed and arranged so that it will be reset to its safe position by the spring returned movement of the setback weight assembly 54, if the first inertial arming lug 84 is in an intermediate position, partway between its safe and arming positions. To provide for the resetting of the first inertial arming lug 84, the rear or underside of the lug 84 is formed with inner and outer safeing or resetting ramps 118 and 120, extending between the inner and outer sets of the openings 98 and 102 in the lug 84. The ramps 118 and 120 are shown most clearly in FIGS. 18, 19 and 20, in which the first inertial arming lug 84 is shown separately. The ramps 118 and 120 are adapted to be engaged by rounded front or upper end portions 122 on the pin portions 62. The rounded end portions 122 have a camming action on the resetting ramps 118 and 120, which may also be regarded as cams.

To facilitate the swinging movement of the first inertial lug 84, the rear or lower side thereof is formed with inner and outer bosses or runners 124 and 126, as shown in FIGS. 17-20, adapted to slide along the first partition wall 50. As illustrated, the inner boss 124 is circular in shape, while the outer boss 126 is arcuately shaped.

Figure 22:
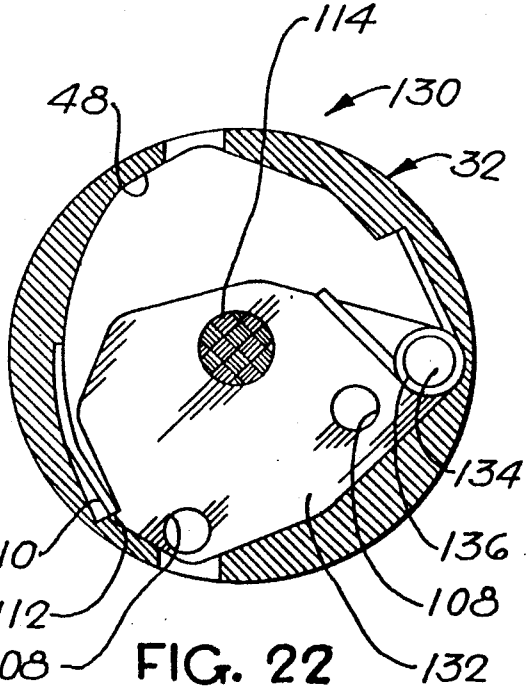
FIG. 22 is a sectional view similar to FIG. 21, but showing the second swingable arming lug in a changed position which is its armed position.
Figure 21:
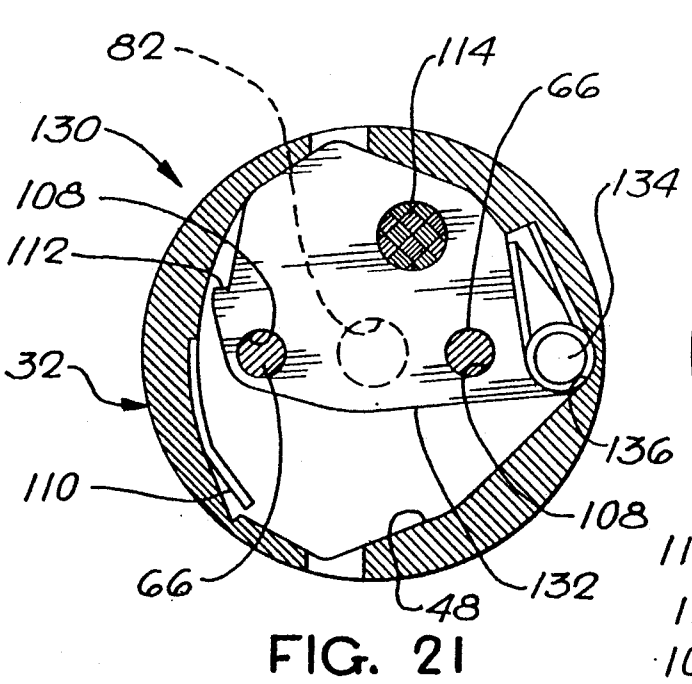
FIG. 21 is a sectional view similar to FIG. 5 but illustrating a modified safe and arming device, constituting another embodiment of the present invention, and showing a modified construction and arrangement of the second swingable arming lug, illustrated in its initial safe position.

Projectiles in general and many military rockets do not experience negative spin acceleration during flight. For such projectiles and rockets, the present invention provides a modified safe and arming device 130, as shown in FIGS. 21 and 22, constituting a second embodiment of the present invention. The modified safe and arming device 130 is very much the same as the safe and arming device 30 of FIGS. 1-20. Only the differences are illustrated in FIGS. 21 and 22, in which the previously used reference characters have been employed to identify the components which are essentially the same as previously described.

The modified safe and arming device 130 employs a modified second inertial arming lug 132 which replaces the previously described lug 86. The shape of the modified lug 132 corresponds generally with a mirror image of the lug 86. As before, the inertial arming lug 132 is swingable in the third chamber 48 of the housing 32. However, the modified inertial arming lug 132 is swingable about a slightly modified pivot pin 134 between the safe position of FIG. 21 and the arming position of FIG. 22. Such arming movement of the inertial lug 132 is in a counterclockwise direction, rather than in a clockwise direction, as previously described in connection with the lug 86. Because of the absence of negative spin acceleration, the impetus for swinging the modified inertial lug 132 between its safe and arming positions is provided by resilient means, illustrated as a coiled torsion spring 136, mounted on the pivot pin 134 and operatively connected between the housing 32 and the inertial arming lug 132.

As before, the modified arming lug 132 is provided with the previously described control openings 108 for receiving the third pin portions 66 which retain the arming lug 132 in its safe position, as shown in FIG. 21, until the pin portions 66 are withdrawn from the openings 108, when the safe and arming device 130 is subjected to predetermined deceleration which causes forward movement of the inertial weight 56. The withdrawal of the pin portions 66 from the openings 108 releases the inertial lug 132, whereupon the spring 136 swings the lug 132 to its arming position, as shown in FIG. 22. As before, the inertial lug 132 blocks any communication between the fire tube openings 78 and 82 when the lug 132 is in its safe position. The lug 132 carries the explosive booster pellet 114 which is securely mounted in the opening 116 in the lug 132, as previously described in connection with the lug 86. When the modified inertial lug 132 is swung into its arming position, as shown in FIG. 22, the booster pellet 114 and the opening 116 are aligned with the firing train formed by the fire tube openings 78, 80 and 82 so that the fire or explosive energy from the detonator 94 is propagated along the fire tube openings and is greatly intensified by the explosive booster pellet 114. As before, the explosive booster pellet 114 is an optional component which is not always needed. When the booster pellet 114 is not needed, it may be omitted from the opening 116, which then propagates the fire or explosive energy from the detonator 94 to the main explosive charge.

The present invention is applicable to warheads and projectiles having electrical firing trains, in which case the inertial arming lugs 84, 86 and 132 operate electrical switches which are indispensable elements in the electrical firing train.

OPERATIONAL SUMMARY

Although the operation of the disclosed embodiments of the present invention has already been described, a brief summary of the operation may be helpful. As to the embodiment of FIGS. 1-20, it is noteworthy that FIGS. 3-14 are arranged in four sets of figures which illustrate successive stages in the operation of the safe and arming device 30. Thus, FIGS. 3, 4 and 5 illustrate the initial condition of the safe and arming device 30, in which the first and second inertial arming lugs 84 and 86 are in their safe positions, in which both lugs block any communication along the firing train formed by the fire tube openings 78, 80 and 82. The setback weight assembly 54 is in a neutral position, in which the springs 100 are not stressed, except to an insignificant extent by gravity. The first inertial arming lug 84 is retained in its safe position by the control pin portions 62, which are inserted into the control openings 98 in the lug 84. The second inertial lug 86 is retained in its safe position by the control pin portions 66 which are inserted into the control openings 108.

FIGS. 6, 7 and 8 illustrate the condition of the safe and arming device 30 during the time when the rocket or projectile is being launched or fired. At that time, the safe and arming device 30 normally experiences a great magnitude of forward acceleration which causes relative movement between the setback weight 56 and the housing 32, so as to bring the weight 56 to its rearwardly displaced setback position, as shown in FIG. 6, against the resilient biasing action of the springs 100, which are greatly compressed. The rearward displacement of the weight 56 also causes rearward displacement of the control pin portions 62, 64 and 66, so that the front pin portions 62 are withdrawn rearwardly from the control openings 98 in the first inertial arming lug 84, so that it is released for swinging movement. The rear pin portions 66 are moved farther into the control openings 108, so that the second inertial arming lug 86 is retained in its safe position.

Figure 9:
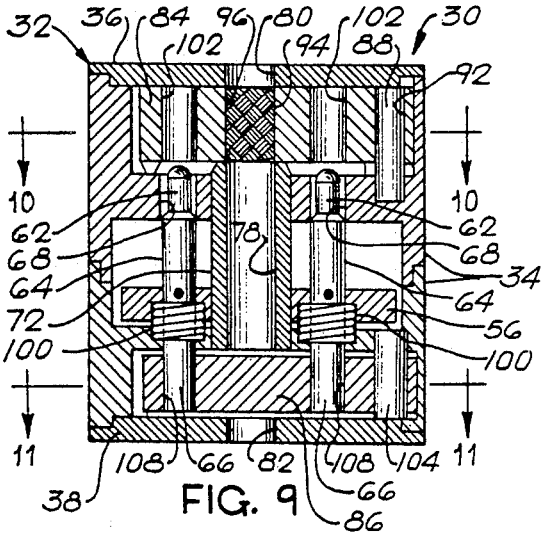
FIG. 9 is a longitudinal section, similar to FIG. 6, but taken generally along the line 9—9 in FIG. 10, and showing the first or upper swingable arming lug in a changed position due to the spin imparted to the rocket or projectile as it is launched.

The first inertial arming lug 84 is adapted to be swung from its safe position of FIG. 7 to its arming position of FIG. 10 in response to spin acceleration of the rocket or projectile. In virtually all instances, a rocket or projectile is caused to spin about its longitudinal axis in order to stabilize the flight of the rocket or projectile. As to rockets, the spin is produced by the configuration of the rocket motor. As to projectiles such as artillery shells, the spin is produced by rifling in the gun barrel. In either case, the spin acceleration of the housing 32 has the effect of causing relative swinging movement between the first inertial arming lug 84 and the housing 32, whereby the lug is effectively swung in a counterclockwise direction to its arming position, as shown in FIGS. 9 and 10. In the arming position, the detonator 94 is aligned with the fire tube openings 78, 80 and 82. However, the gap between the fire tube openings 78 and 82 is still blocked by the second inertial arming lug 86, so that the condition of the safe and arming device is still safe.

In the case of a rocket, the forward acceleration thereof is terminated when the rocket motor burns out completely. In the case of a projectile fired from a gun barrel, the forward acceleration terminates after the projectile has been shot from the barrel. When the housing 32 is no longer being accelerated forwardly, the springs 100 cause forward return movement of the setback weight 56 so that the first and second control pin portions 62 and 64 are thrust into the openings 102 in the first inertial arming lug 84. The openings 102 are large enough to receive the second pin portions 64 which are larger in diameter than the first pin portions 62. After the forward acceleration has been terminated, the rocket or projectile experiences deceleration due to air friction drag. The deceleration causes additional forward movement of the inertial weight 56, against the resilient biasing action of the springs 100 so that the third control pin portions 66 are withdrawn from the control openings 108 in the second inertial arming lug 86, as shown in FIG. 12. Thus, the second arming lug 86 is released for swinging movement to its arming position, as shown in FIGS. 12 and 14. In the arming position of the second inertial lug 86, the explosive booster pellet 114 and its mounting opening 116 in the lug 86 are aligned with the fire tube openings 78, 80 and 82, so that the safe and arming device 30 is in its fully armed condition. Thus, the detonation energy can be propagated along the fire tube openings 78 and 82. The provision of the explosive booster pellet 114 is an optional feature. If the booster pellet 114 is not needed, the opening 116 is simply left open so that it will propagate the detonation energy between the fire tube openings 78 and 82.

In the embodiment of FIGS. 1–20, the second inertial arming lug 86 is adapted to be swung in a clockwise direction to its arming position by reverse or negative spin acceleration of the housing 32. Such negative spin acceleration is produced in certain rockets by the configuration of the tail fins, which are warped or otherwise shaped to decrease the spin velocity of the rocket due to the action of the air stream on the tail fins. The second inertial arming lug 86 is latched in its arming position by the latching spring 110, which cooperates with the latching tooth 112.

Negative or reverse spin acceleration is an optional feature which is not employed as to many rockets and virtually not at all as to projectiles. For applications not involving negative spin acceleration, the second inertial arming lug 86 can be swung to its arming position by spring means, as illustrated by the modified safe and arming device 130 of FIGS. 21 and 22, in which the second inertial arming lug is designated 132. When the arming lug 132 is released for swinging movement, as previously described in connection with FIG. 12, the second arming lug 132 is swung counterclockwise to its arming position by the torsion spring 136, as shown in FIG. 22. If desired, the safe and arming device 30 of FIGS. 1–20 could be modified in a similar manner to employ resilient means such as a torsion spring to swing the second inertial arming lug 86 to its arming position.

An additional safety feature of the present invention resides in the provision of the safeing or resetting ramps 118 and 120 on the first inertial arming lug 84, as shown to best advantage in FIGS. 17–20. If the first inertial arming lug 84 is swung only partway between its safe and arming positions, due to the lack of sufficient spin acceleration or some other cause, the first inertial arming lug 84 is returned or reset to its safe position by the camming action of the rounded end portions 122 of the first pin portions 62, acting against the ramps 118 and 120, when the setback weight assembly 54 is returned forwardly by the springs 100, after the termination of the forward acceleration of the rocket or projectile. The pin portions 62 are thrust into the openings 98 so as to retain the first inertial arming lug 84 in its safe position.

The safe and arming devices of the present invention provide a high degree of safety, in that the launching and the initial flight of the rocket or projectile must proceed in a normal manner in order to change the device from a safe condition to a fully armed condition. Thus, premature detonation of the main explosive charge is prevented with a high degree of reliability.

Nevertheless, the safe and arming devices have only a few uncomplicated moving parts, so that the devices can easily be manufactured at low cost.

Further modifications, alternative constructions and equivalents may be employed without departing from the true spirit and scope of the present invention, as disclosed in the drawings and the preceding description, and as defined in the following claims.

I claim:

1. A safe and arming device for warheads and projectiles, said device comprising a housing having first, second and third successive chambers therein;

a setback weight assembly including an acceleration responsive setback weight movable in said second chamber in first and second opposite directions along a predetermined path between an initial position and a setback position;

spring means for resiliently biasing said setback weight in said first direction toward said initial position, said setback weight being movable in said second direction relative to said housing to said setback position in response to predetermined acceleration of said housing in said first direction;

said housing having fire tube means along said path for propagating fire in said second direction;

a first inertial arming lug movable in said first chamber;

detonator means mounted on said first inertial arming lug;

first pivot means connected between said housing and said first inertial lug and supporting said lug for swinging movement in said first chamber in first and second angular directions between an initial safe position, with said detonator means out of alignment with said first tube means, and an arming position, with said detonator means aligned with said fire tube means;

said setback weight assembly comprising first control pin means thereon including a first pin portion movable into and out of said first chamber;

said first inertial lug having a first control opening for receiving said first pin portion when said first inertial lug is in said safe position whereby said first inertial lug is retained in said safe position by said first pin portion;

movement of said weight to said setback position being operative to withdraw said first control pin means from said first control opening for releasing said first inertial lug;

said first inertial lug being responsive to spin acceleration of said housing for causing relative swinging movement of said first inertial lug and said housing to bring said first inertial lug to said arming position;

a second inertial lug movable in said third chamber;

and second pivot means connected between said housing and said second inertial lug and supporting said second inertial lug for swinging movement between said safe and arming positions;

said second inertial lug having means operative in said safe position thereof for blocking said fire tube means;

said second inertial lug having a fire-propagating opening therein movable into alignment with said fire tube means when said second inertial lug is swung into said arming position to provide for propagation of fire along said fire tube means;

said setback weight assembly including second control pin means movable in opposite directions into and out of said second chamber;

said second inertial lug having a second control opening therein for receiving said second control pin means when said second inertial lug is in its safe position;

said second control pin means being partially received in said second control opening for initially holding said second inertial lug in its safe position;

said second control pin means being movable further into said second control opening in response to setback movement of said weight;

said first inertial lug having an additional control opening therein along with said first control pin means when said first inertial lug is in its arming position;

said first control pin means having an additional pin portion of larger diameter than said first pin portion and being aligned with said additional control opening when said first inertial lug is in its arming position;

said weight being movable relative to said housing along said predetermined path between said initial position and a forwardly displaced position in response to predetermined deceleration of said housing due to air friction drag on the warhead or projectile;

said spring means also affording resilient biasing resistance to movement of said weight from said initial position to said forwardly displaced position;

said additional pin portion being movable into said additional control opening while said second control pin means is withdrawn from said second control opening in response to movement of said weight between said initial position and said forwardly displaced position, whereby said second inertial lug is released to enable swinging movement thereof;

said second inertial lug being constructed and arranged for producing swinging movement of said second inertial lug from its safe position to its arming position after said second inertial lug is released by the withdrawal of said second control pin means from said second control opening.

2. A safe and arming device according to claim 1, including latching means for latching said second inertial lug in its arming position.

3. A safe and arming device according to claim 1, in which said first inertial lug includes safeing ramp means engageable by said first control pin means in response to deceleration of said housing for returning said first inertial lug to its safe position if said first inertial lug is in an intermediate position between its safe and arming positions.

4. A safe and arming device according to claim 3, in which said safeing ramp means extends between said additional control opening and said first control opening.

5. A safe and arming device according to claim 3, comprising a pair of said safeing ramp means.

6. A safe and arming device according to claim 1, said spring means comprising a coil spring received around said second control pin means and operative between said setback weight and a portion of said housing.

7. A safe and arming device according to claim 6, comprising a pair of said coil springs.

8. A safe and arming device according to claim 1, comprising a pair of said spring means, a pair of said first control pin means including a pair of said first pin portions, a pair of said first control openings for receiving said pin portions, a pair of said second control pin means, a pair of said second control openings for receiving said second control pin means, a pair of said additional control openings in said first inertial lug, and a pair of said additional pin portions of larger diameter than said first pin portions.

9. A safe and arming device according to claim 1, in which said first control pin means and said second control pin means comprise respective first and second portions of a unitary control pin formed in one piece and mounted on said setback weight.

10. A safe and arming device according to claim 9, comprising a pair of said unitary control pins mounted in parallel positions on said setback weight.

11. A safe and arming device according to claim 10, in which said housing comprises guide means disposed between said second and third chambers and having guide openings for slidably guiding said unitary control pins.

12. A safe and arming device according to claim 11, said spring means comprising a pair of coil springs received around said second portions of said unitary control pins and operative between said setback weight and said guide means.

13. A safe and arming device according to claim 1, comprising an explosive booster pellet mounted in said fire-propagating opening in said second inertial lug.

14. A safe and arming device according to claim 1, in which said second inertial lug is swingable relative to said housing in response to reverse spin acceleration of said housing whereby said second inertial lug is swung into its arming position after said second inertial lug is released by the withdrawal of said second control pin means from said second control opening.

15. A safe and arming device according to claim 14, in which said second inertial lug and said second pivot means are constructed and arranged such that said second inertial lug is swingable between its safe and arming positions in an angular direction which is opposite from the direction of swinging movement of said first inertial lug between its safe and arming positions.

16. A safe and arming device according to claim 1, comprising additional spring means operative between said housing and said second inertial lug for resiliently biasing said second inertial lug toward its arming position whereby said second inertial lug is swung into said arming position after said second inertial lug is released by the withdrawal of said second control pin means from said second control opening.

17. A safe and arming device according to claim 16, in which said first and second inertial lugs are swingable in the same angular direction between their respective safe and arming positions.

18. A safe and arming device for warheads and projectiles, said device comprising a housing having at least first and second chambers therein;

a setback weight assembly including an acceleration responsive setback weight movable in said second chamber in first and second opposite directions along a predetermined path between an initial position and a setback position;

spring means for resiliently biasing said setback weight in said first direction toward said initial position, said setback weight being movable in said second direction relative to said housing in response to acceleration of said housing in said first direction;

said housing having fire tube means for propagating fire therealong;

an inertial arming lug movable in said first chamber;

detonator means mounted on said inertial arming lug;

pivot means connected between said housing and said inertial arming lug and supporting said lug for swinging movement in said first chamber in first and second angular directions between an initial safe position, with said detonator means out of alignment with said fire tube means, and an arming position, with said detonator means aligned with said fire tube means;

said setback weight assembly comprising control pin means thereon movable into and out of said first chamber;

said inertial arming lug having a first control opening for receiving said control pin means when said inertial arming lug is in said safe position whereby said inertial arming lug is retained in said safe position by said control pin means;

movement of said weight to said setback position being operative to withdraw said control pin means from said first control opening for releasing said inertial arming lug;

said inertial arming lug being responsive to spin acceleration of said housing for causing relative swinging movement of said inertial arming lug and said housing to bring said inertial arming lug to said arming position thereof;

said inertial arming lug having an additional control opening therein aligned with said control pin means when said inertial arming lug is in its arming position;

said control pin means being movable into said additional control opening in response to return of said weight to its initial position;

said control pin means thereby being effective to retain said inertial arming lug in its arming position;

said inertial arming lug including safeing ramp means engageable by said control pin means in response to return movement of said weight for returning said inertial arming lug to its safe position if said inertial arming lug is in an intermediate position between its safe and arming positions.

19. A safe and arming device according to claim 18, said safeing ramp means extending between said additional control opening and said first control opening.

20. A safe and arming device for warheads and projectiles, said device comprising a housing having at least first and second chambers therein;

a setback weight assembly including an acceleration responsive setback weight movable in said second chamber in first and second opposite directions along a predetermined path between an initial position and a setback position;

spring means for resiliently biasing said setback weight in said first direction toward said initial position, said setback weight being movable in said second direction relative to said housing in response to acceleration of said housing in said first direction;

said housing having first tube means for propagating fire therealong;

an inertial arming lug movable in said first chamber;

detonator means mounted on said inertial arming lug;

pivot means connected between said housing and said inertial arming lug and supporting said lug for swinging movement in said first chamber in first and second angular directions between an initial safe position, with said detonator means out of alignment with said fire tube means, and an arming position, with said detonator means aligned with said fire tube means;

said setback weight assembly comprising control pin means thereon movable into and out of said first chamber;

said inertial arming lug having a first control opening for receiving said control pin means when said inertial arming lug is in said safe position whereby said inertial arming lug is retained in said safe position by said control pin means;

movement of said weight to said setback position being operative to withdraw said control pin means from said first control opening for releasing said inertial arming lug;

said inertial arming lug being responsive to spin acceleration of said housing for causing relative swinging movement of said inertial arming lug and said housing to bring said inertial arming lug to said arming position thereof;

said inertial arming lug having an additional control opening therein aligned with said control pin means when said inertial arming lug is in its arming position;

said control pin means being movable into said additional control opening in response to return of said weight to its initial position;

said control pin means thereby being effective to retain said inertial arming lug in its arming position;

said safe and arming device comprising a pair of said control pin means;

said inertial arming lug having a pair of said first control openings for receiving said pair of said control pin means when said inertial arming lug is in its safe position;

said inertial arming lug having a pair of said additional control openings for receiving said pair of said control pin means when said inertial arming lug is in its arming position.

21. A safe and arming device according to claim 20, in which said inertial arming lug includes a pair of safeing ramp means engageable by said pair of control pin means in response to return movement of said weight for returning said inertial arming lug to its safe position if said inertial arming lug is in an intermediate position between its safe and arming positions.

22. A safe and arming device according to claim 20, in which said housing comprises a pair of guide means for slidably receiving and guiding said pair of control pin means for movement of said setback weight and said control pin means in said first and second directions.

23. A safe and arming device for warheads and projectiles, said device comprising a housing, an acceleration responsive setback weight in said housing, guide means for guiding said setback weight for movement in said housing in first and second opposite directions along a predetermined path between an initial position and a setback position;

resilient means for resiliently biasing said setback weight in said first direction toward said initial position;

said setback weight being movable in said second direction relative to said housing to said setback position in response to predetermined acceleration of said housing in said first direction;

said housing having fire tube means for propagating fire therealong;

an inertial arming lug movable in said housing;

detonator means mounted on said inertial arming lug;

pivot means extending between said housing and said inertial arming lug and supporting said lug for swinging movement between an initial safe position, with said detonator means out of alignment with said fire tube means, and an arming position, with said detonator means aligned with said fire tube means;

control means operable by said setback weight for initially retaining said inertial arming lug in its safe position when said setback weight is in its initial position;

said control means being operable by setback movement of said weight to its setback position for releasing said inertial arming lug;

said inertial arming lug being responsive to spin acceleration of said housing for causing relative swinging movement of said inertial arming lug and said housing to bring said inertial arming lug to said arming position thereof;

said control means being operative to retain said inertial arming lug in its arming position in response to return movement of said setback weight to its initial position;

and resetting means operable by said control means for returning said inertial arming lug to its safe position in response to return movement of said setback weight to its initial position if said inertial arming lug is in an intermediate position between its safe position and its arming position.

24. A safe and arming device according to claim 23, said resetting means including ramp means on said inertial arming lug, said control means including a component engageable with said ramp means when said inertial arming lug is in an intermediate position between its safe and arming positions for returning said inertial arming lug to its safe position.

25. A safe and arming device for warheads and projectiles, said device comprising a housing, an acceleration responsive setback weight in said housing, guide means for guiding said weight for movement in said housing in first and second opposite directions along a predetermined path between an initial position and a setback position;

resilient means for resiliently biasing said weight in said first direction toward said initial position;

said weight being movable in said second direction relative to said housing to said setback position in response to acceleration of said housing in said first direction;

firing train means in said housing and having a first operative element thereon in a fixed relation thereto;

an inertial arming lug movable in said housing;

said firing train means having a second selectively operative element thereof on said inertial arming lug and movable therewith;

pivot means extending between said housing and said inertial arming lug and supporting said lug for swinging movement between an initial safe position, with said second selectively operative element out of operative relation with said first operative element of said firing train means, and an arming position, with said second selectively operative element in an operative relation with said first operative element of said firing train means;

control means operable by said weight for initially retaining said inertial arming lug in its safe position when said weight is in its initial position;

said control means being operable by setback movement of said weight to its setback position for releasing said inertial arming lug;

said inertial arming lug being responsive to spin acceleration of said housing for causing relative swinging movement of said inertial arming lug and said housing to bring said inertial arming lug to said arming position thereof;

said control means being operative to retain said inertial arming lug in its arming position in response to return movement of said setback weight to its initial position;

said control means including first means operable by setback movement of said weight to its setback position for releasing said inertial arming lug;

said control means including second means operable by return movement of said weight to its initial position for retaining said inertial arming lug in its arming position;

and a second inertial arming lug movable in said housing;

said firing train means having a third selectively operative element thereof on said second inertial arming lug and movable therewith;

pivot means extending between said housing and said second inertial arming lug and supporting said second lug for swinging movement between an initial safe position, with said third selectively operative element out of operative relation with said first operative element of said firing train means, and an arming position, with said third selectively operative element in an operative relation with said first operative element of said firing train means;

additional control means operable by said weight for initially retaining said second inertial arming lug in its safe position when said weight is in its initial position;

said additional control means being operative to continue to retain said second inertial arming lug in its safe position in response to setback movement of said weight to its setback position;

said guide means being additionally operative to guide said weight between said initial position and a forwardly displaced position;

said resilient means being additionally operative to bias said weight in said second direction from said forwardly displaced position toward said initial position;

said weight being operable in response to predetermined deceleration of said housing for causing relative movement of said weight and said housing to bring said weight to said forwardly displaced position;

said additional control means being operable by movement of said weight to its forwardly displaced position for releasing said second inertial arming lug;

said second inertial arming lug being constructed and arranged for producing swinging movement of said second inertial arming lug from its safe position to its arming position when said second inertial arming lug is released by said additional control means.

26. A safe and arming device according to claim 25, including latching means for latching said second inertial arming lug in its arming position.

27. A safe and arming device according to claim 25, in which said second inertial arming lug is swingable relative to said housing in response to reverse spin acceleration of said housing whereby said second inertial arming lug is swung into its arming position after said second inertial arming lug is released by said additional control means.

28. A safe and arming device according to claim 27, in which said second inertial arming lug and said second pivot means are constructed and arranged such that said second inertial arming lug is swingable between its safe and arming positions in an angular direction which is opposite from the direction of swinging movement of said first inertial arming lug between its safe and arming positions.

29. A safe and arming device according to claim 25, comprising additional resilient means operative between said housing and said second inertial arming lug for resiliently biasing said second inertial arming lug toward its arming position whereby said second inertial arming lug is swung into its arming position after said second inertial arming lug is released by said additional control means.

30. A safe and arming device according to claim 29, in which said first and second inertial arming lugs are swingable in the same angular direction between their respective safe and arming positions.

* * * * *